US005161328A

United States Patent [19]

Traue

[11] Patent Number: 5,161,328

[45] Date of Patent: Nov. 10, 1992

[54] SERVICE HATCH INSERTABLE IN DOORS AND WALLS

[76] Inventor: Horst Traue, Debyestrasse 52, 5100 Aachen, Fed. Rep. of Germany

[21] Appl. No.: 721,625

[22] PCT Filed: Nov. 18, 1989

[86] PCT No.: PCT/DE89/00724

§ 371 Date: Jul. 19, 1991

§ 102(e) Date: Jul. 19, 1991

[87] PCT Pub. No.: WO90/05827

PCT Pub. Date: Mar. 31, 1990

[30] Foreign Application Priority Data

Nov. 21, 1988 [DE] Fed. Rep. of Germany ... 8814487[U]

[51] Int. Cl.[5] ..... E06B 7/28

[52] U.S. Cl. ..... 49/171

[58] Field of Search ..... 49/171, 169; 160/180

[56] References Cited

U.S. PATENT DOCUMENTS 1,186,565 6/1916 Fogg ..... 49/169

1,722,113 7/1929 Sklar ..... 49/171

2,096,740 10/1937 Frankel ..... 49/171 X 4,245,566 1/1981 Shimansky et al. ..... 49/171 X

FOREIGN PATENT DOCUMENTS 512068 10/1930 Fed. Rep. of Germany ..... 49/171

695361 12/1930 France ..... 49/171

64411 3/1927 Sweden ..... 49/171

*Primary Examiner*—Philip C. Kannan

*Attorney, Agent, or Firm*—Staas & Halsey

[57] ABSTRACT

A service hatch insertable in doors and walls, with a frame insertable in an opening of a door or of a wall and a closing part connected to said frame and incorporating a service opening, whereby the closing part has a shock-proof, transparent panel, a fixing slot for fixing one edge of this panel and, on the opposite edge of the panel, a hinged handle which can be turned around a turning axle parallel to the two edges. The handle bears a support rod at a distance from the turning axle, on which support rod the neighboring edge of the panel rests.

14 Claims, 4 Drawing Sheets

SERVICE HATCH INSERTABLE IN DOORS AND WALLS

DESCRIPTION

Figure 1:
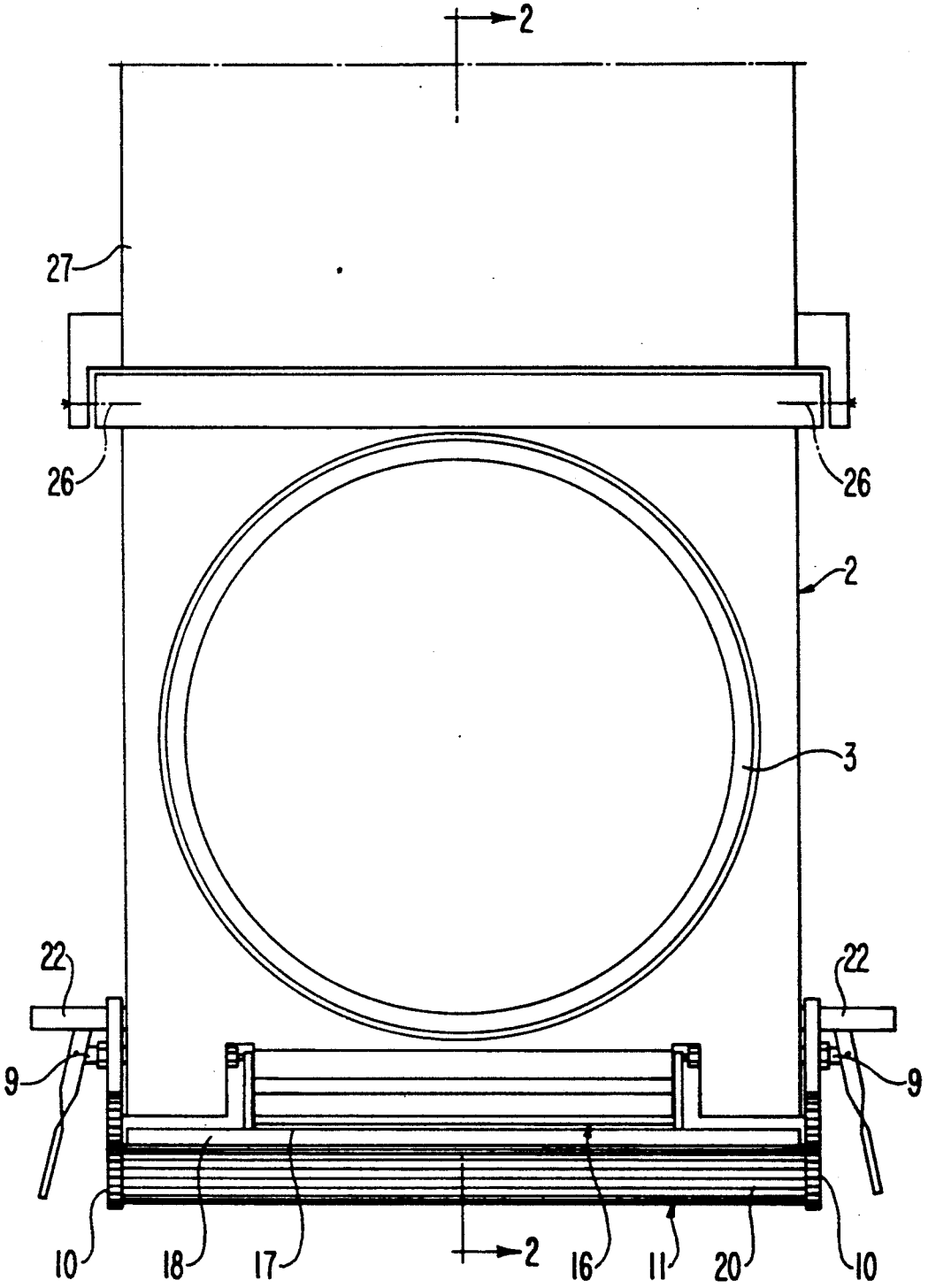

The invention concerns a service hatch insertable in doors and walls, with a frame insertable in an opening of a door or of a wall and a closing part connected to said frame and incorporating a service opening.

For a long time now, there has been a need to provide apartment doors in particular with such service hatches which allow an adequate view through the door and furthermore enable small items, documents, newspapers, letters and similar to be passed through the door without requiring the door to be opened. For elderly people, the disabled and children in particular, the need to open the apartment door to unknown third parties in order to receive the above-specified items, for example, involves an increasing degree of danger.

The invention concerned here is intended to fulfil the requirement for a service hatch of the above-mentioned type which is simple to handle, and which can be installed in a new or existing door leaf or wall via simple means.

In accordance with the invention, this task is solved via a service hatch of the above-mentioned type, characterised in that the closing part has a shock-proof, transparent panel, a fixing slot for fixing one edge of this panel and, on the opposite edge of the panel, a hinged handle which can be turned around a turning axle parallel to the two edges, whereby said handle bears a support rod at a distance from the turning axle, on which support rod the neighbouring edge of the panel rests.

The frame may be round or angular. It can be firmly connected to the closing part. Both parts form a firm anchoring unit to secure the service hatch in the door or wall.

By operating the hinged handle, the transparent panel can be removed from the fixing slot and released, to enable it to be swung up. It is possible to extend the width to the edge of the fixing slot, thereby creating a gap between the closing part and the panel prior to swinging up the panel, for the purpose of verbal communication.

A further embodiment of the invented service hatch involves a design whereby the fixing slot is located in the upper section of the closing part and the turning axle in the lower section. The opening movements are then assisted by the force of gravity.

A further embodiment of the invented service hatch involves the provision of two stops in the closing part, to limit the path of movement of the support rod, said stops defining the highest and lowest position of the support rod. When the support rod is in its highest position, the panel is inserted as far as possible in the fixing slot in closed position, or it may rest on the handle in open position.

A further embodiment of the service hatch involves a design whereby the handle has two parallel side-pieces and a handlebar which is held by the side-pieces, whereby the turning axle and the support rod are installed on bearings in the side-pieces. This results in a particularly simple, reliably operating construction.

A further embodiment of the invented service hatch involves a design whereby the handle is provided with at least one releasable locking bolt, which slots into the closing part for the purpose of locking the handle. This enables the handle and, subsequently, the panel to be fixed in any desired position, e.g. in completely closed position or in a partially open position for the purpose of verbal communication.

A further embodiment of the invented service hatch involves fixing the locking bolt(s) to a side-piece or both side-pieces of the handle. This results in advantages with regard to handling in particular.

A further embodiment of the invented service hatch involves each locking bolt being spring-loaded in the direction of its locking position. As a result, each bolt slots automatically into the next secured position.

A further embodiment of the invented service hatch involves each locking bolt being provided with a release lever. Such a lever, which is most expediently located on the handle, enables simple release of the fixing bolts and subsequent movement of the handle.

A further embodiment of the invented service hatch involves the provision of a joint release lever for the locking bolts. This further simplifies handling. The hatch can then be operated simply with one hand only.

A further embodiment of the invented service hatch involves the handle forming a rest for the panel when the latter is open. In this way, a firm rest is provided for the panel, making the panel particularly suitable as a support for writing and similar purposes.

Finally, a further embodiment of the invented service hatch involves said hatch being provided with a hinged, non-transparent closing panel which is supported by the closing part and which covers the service opening. By means of this closing part the view through the service opening can be entirely blocked off.

Figure 2:
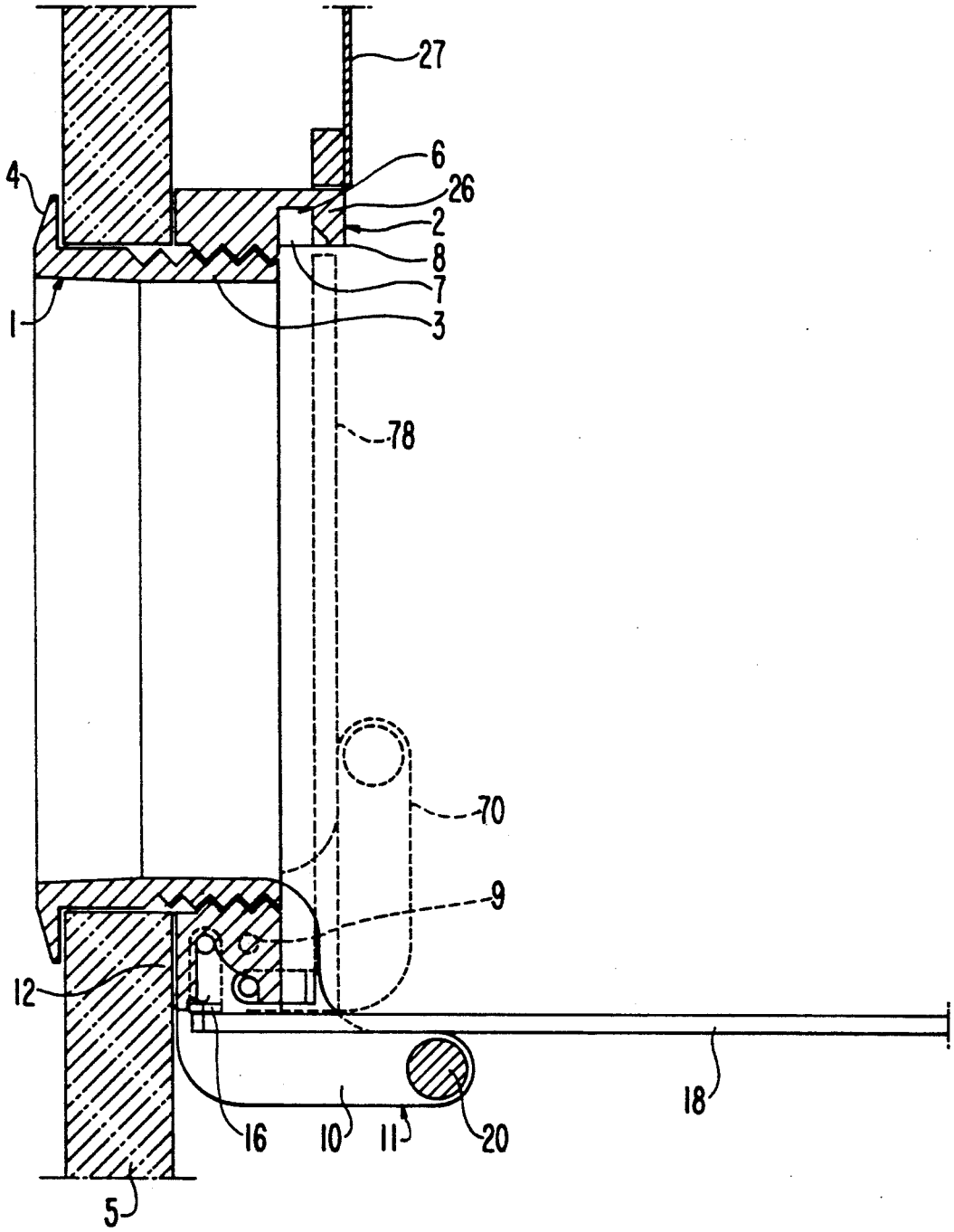
Figure 3:
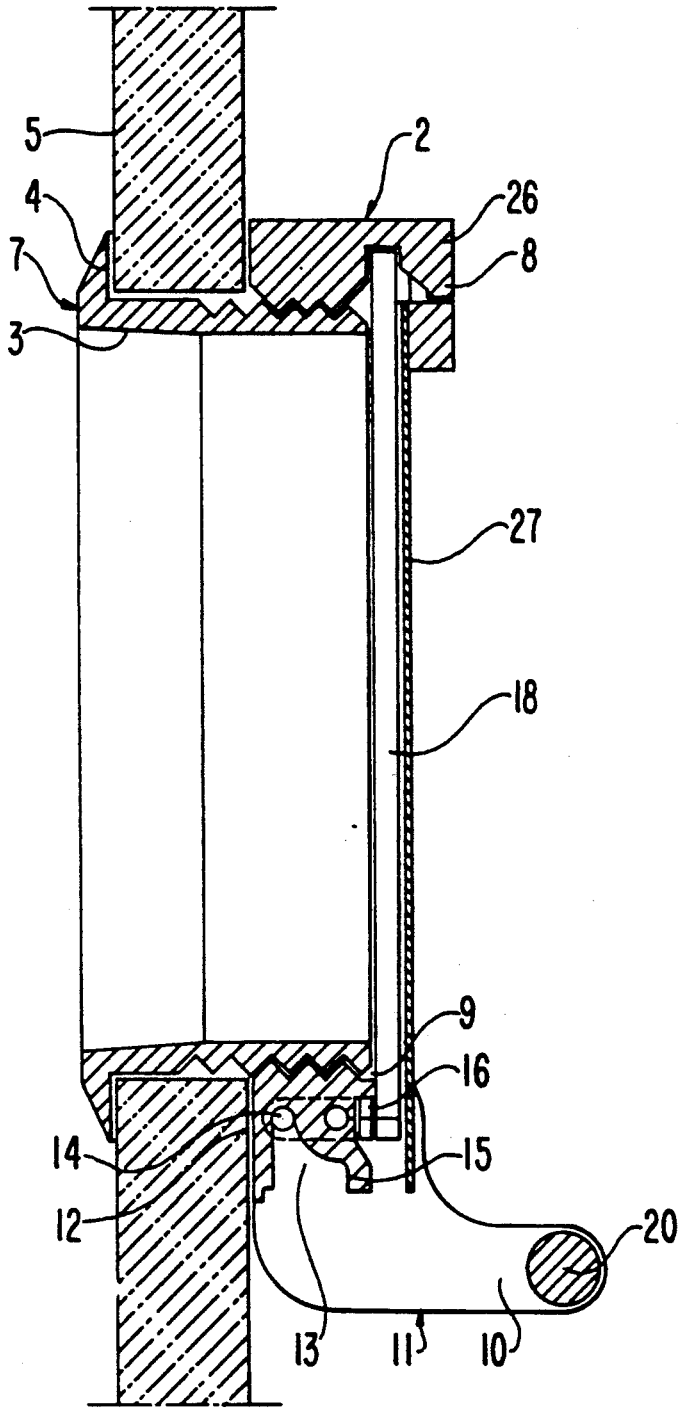
Figure 4:
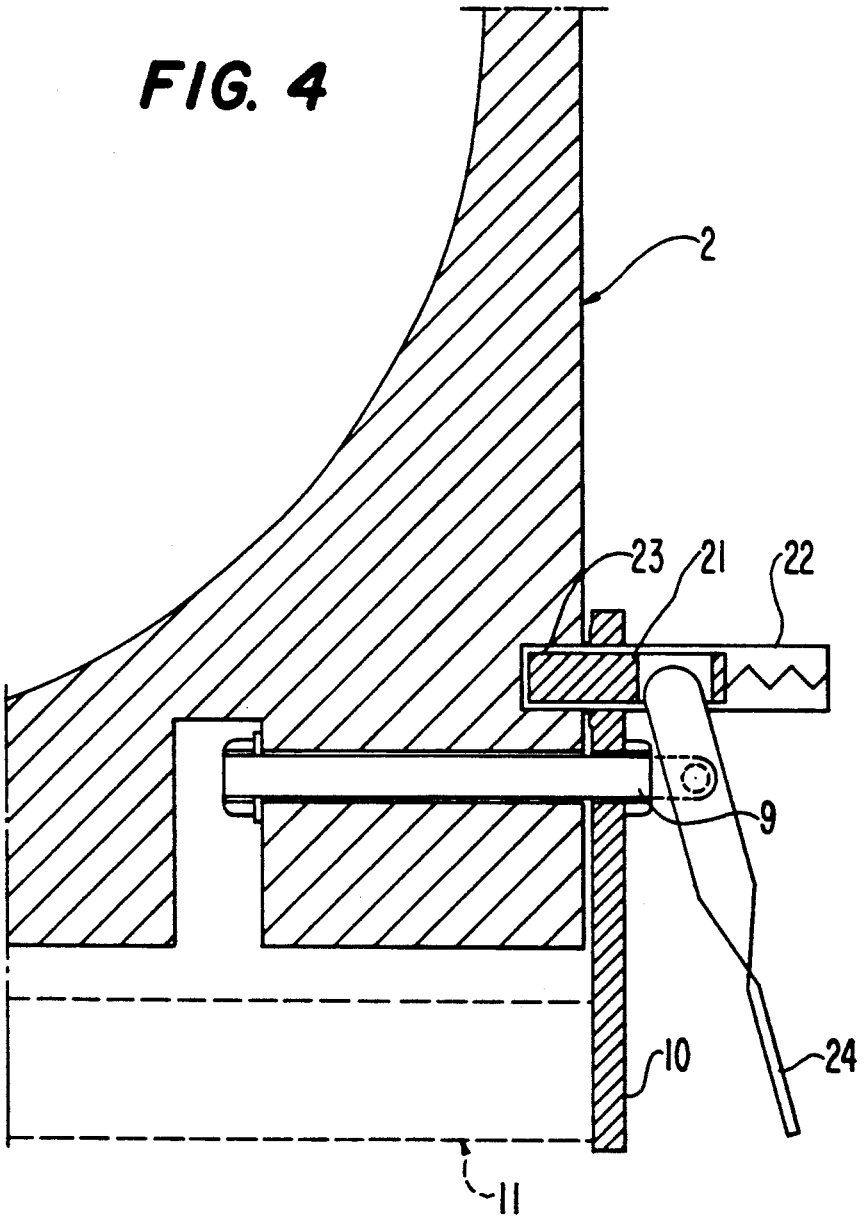

The following part of the description illustrates an embodiment of the invented service hatch by means of drawings. The following are shown:

FIG. 1: a plan view of the inside of an embodiment of the invented service hatch with open closing panel, FIG. 2: a section corresponding to the line 2—2 in FIG. 1, whereby the handle is additionally shown in its top position in broken lines, FIG. 3: a section corresponding to the line 2—2 in FIG. 1, whereby the transparent panel and the closing panel are in closed position and FIG. 4: a partial section concerning the configuration of a locking bolt on one side-piece of the handle.

The embodiment of the invented service hatch presented in the figures has a frame, 1, and a closing part, 2. The frame, 1, has a shaft, 3, and an outer flange, 4. The shaft, 3, passes through a wall or a door, 5, against the outside of which the flange, 4, rests. The closing part, 2, is positioned on the shaft, 3, on the inside of the door, 5, so that the door, 5, is fixed on the shaft, 3, between the flange, 4 and the closing part, 2.

The closing part, 2, has a fixing slot, 6, in its upper section, whereby the lower area, 7, of said fixing slot, 6, is widened towards the outside and forms a supporting shoulder, 8.

Installed in the lower section of the closing part, 2, are two aligned turning axles, 9, in place of which one continuous turning axle could also be installed. On the side edges of the closing part, 2, a side-piece, 10, of a handle, 11, is installed on each of the projecting ends of the turning axle, 9. A support rod, 12, runs parallel to the turning axles, 9, passing continuously from one side-piece, 10, to the next. In the lower section of the closing part, 2, a recess, 13, is cut out for the path of movement of the support rod, 12. This recess, 13, forms an upper stop, 14, and a lower stop, 15, for the support rod, 12. Located in hinged configuration on the support rod, 12, are the two ends of a U-shaped connecting element, 16, the web, 17, of which is connected to a panel, 18, produced in a transparent, shock-proof material.

The handle, 11, has a handlebar, 20, which runs parallel to the turning axles, 9, and the support rod, 12, and which joins together the two side-pieces, 10.

Fixed to the side-pieces, 10, is a locking bolt, 21, which is installed in a housing, 22, and which is spring-loaded in the direction of the locked position. In the position shown in FIG. 4, the locking bolt, 21, is inserted into a borehole, 23, of the closing part, 2. By means of a release lever, 24, this locked position, which can secure the handle, 11, in the completely closed and/or partially open position of the panel, 18, can be released, enabling the handle, 11, to be moved again.

Further boreholes for the locking bolt, 21, can be provided in the closing part, 2, to enable the handle, 11, and subsequently the panel, 18, to be held securely in additional positions.

As FIG. 1 shows, in the presented embodiment both side-pieces, 10, are equipped with appropriate locking bolts, 21.

A closing panel, 27, is installed in the upper section of the closing part, 2, whereby said closing panel, 27, can be turned around an axle, 26, and covers the panel, 18.

FIG. 3 shows the service hatch in completely closed position. To open the hatch, the closing panel, 27, is first of all swung up around the axle, 26. A clear view is now provided through the transparent panel, 18. This panel, 18, is located in its completely closed position. If the handle, 11, is turned in anti-clockwise direction in the drawings, the support rod, 12, will move down along a circular path. As a result, panel 18 is also lowered and detaches itself from its support. Panel 18 can be lowered until this panel is resting on the support shoulder, 8. In this position, communication is possible through the service hatch.

If the service hatch is now to be opened completely, the handle, 11, is moved further in anti-clockwise direction, until the support rod, 12, finally comes to rest against its lower stop, 15. Panel 18 has now reached its bottom position. It can now be swung around the turning axles, 9, in clockwise direction and finally reaches the position shown in FIG. 2, in which it rests against the handlebar, 20.

I claim:

1. A service hatch for insertion in a door or a wall, said hatch comprising:

an outer frame having a main body and an elongated shaft configured for insertion through a hole in a door or a wall, said shaft having a distal end disposed in spaced relationship to said main body, said frame having a service opening therethrough which extends longitudinally through the shaft from said distal end and through said main body;

an inner frame connectable to the distal end of said shaft in such a way that the wall or door is fixed between the frames and said service opening extends through the hole in the wall or door;

a handle mechanism including a swingable component mounted on said inner frame adjacent said service opening for swinging about a first axis;

a planar, shock proof, transparent panel for covering said service opening at the distal end of the shaft, said panel having an edge portion;

a connecting bracket fixed to the panel adjacent said edge portion, said bracket being rotatably attached to said swingable component for rotation about a second axis which is parallel to and spaced laterally from said first axis, whereby swinging of said swingable component about said first axis causes said second axis and thereby said panel to move in a direction laterally of said first axis.

2. A service hatch as set forth in claim 1, wherein said panel has a second edge portion which is spaced laterally from said first mentioned edge portion, there being an elongated, horizontally extending slot in said inner frame disposed above said service opening for recieving and fixing said second edge portion when the latter is pushed vertically into said slot, said first axis being disposed to extend horizontally beneath said opening, whereby swinging of said swingable component about said first axis causes said second axis, said panel and thereby said second edge portion to move vertically toward and away from said slot.

3. A service hatch as set forth in claim 2, wherein a pair of spaced stops are provided on the inner frame for limiting vertical movement of the second axis and the panel to thereby define an upper closed position and a lower open position for the panel.

4. A service hatch as set forth in claim 3, wherein said handle mechanism includes a second component providing a rest for said panel when the latter is in its lower open position.

5. A service hatch as set forth in claim 1, wherein said handle mechanism includes a pair of said swingable components and an elongated handle bar, said components being spaced apart longitudinally of said first axis, said handle bar being attached between the components.

6. A service hatch as set forth in claim 5, wherein is included a releasable lock mechanism for releasably holding said components in a fixed position relative to said inner frame.

7. A service hatch as set forth in claim 6, wherein said locking mechanism includes a respective elongated, slidable bolt carried by each component and a corresponding respective hole for each bolt in said inner frame.

8. A service hatch as set forth in claim 6, wherein said lock mechanism includes a respective spring biasing each said bolt toward its corresponding hole.

9. A service hatch as set forth in claim 8, wherein is included lever means for moving said bolts out of said holes against the bias of said springs.

10. A service hatch as set forth in claim 1, wherein is included a releasable lock mechanism for releasably holding said component in a fixed position relative to said inner frame.

11. A service hatch as set forth in claim 10, wherein said lock mechanism includes an elongated, slidable bolt carried by said component and a bolt hole in said inner frame.

12. A service hatch as set forth in claim 11, wherein said lock mechanism includes a spring biasing said bolt toward said hole.

13. A service hatch as set forth in claim 12, wherein is included a lever for moving said bolts out of said hole against the bias of said spring.

14. A service hatch as set forth in claim 1, wherein is included a hinged, non-transparent closing panel supported by the inner frame for covering the service opening.

* * * * *